US006101849A

United States Patent [19]

Pernick

[11] Patent Number: 6,101,849

[45] Date of Patent: Aug. 15, 2000

[54] LOW ABRASION YARN CARRIER FOR KNITTING MACHINES

[75] Inventor: Bruce M. Pernick, Stamford, Conn.

[73] Assignee: Monarch Knitting Machinery Corporation, Glendale, N.Y.

[21] Appl. No.: 09/197,032

[22] Filed: Nov. 20, 1998

[51] Int. Cl.[7] ..... D04B 15/58

[52] U.S. Cl. ..... 66/141; 66/125 R

[58] Field of Search ..... 66/125 R, 143, 66/142, 141, 111, 131, 130, 126 A

[56] References Cited

U.S. PATENT DOCUMENTS

| | | |
|---|---|---|
| 4,441,339 | 4/1984 | Yorisue . |
| 4,916,925 | 4/1990 | Pernick . |
| 5,127,241 | 7/1992 | Plath . |
| 5,259,208 | 11/1993 | Mizuno . |

*Primary Examiner*—Danny Worrell
*Attorney, Agent, or Firm*—Alston & Bird LLP

[57] ABSTRACT

A yarn carrier designed to minimize needle wear yet which is relatively easy to thread is described. The yarn carrier includes a yarn guide having an aperture for receiving a yarn and directing it to the needles of a knitting machine, and a flexible, nonmetallic guard plate secured to the guide such that at least a portion of the guard plate overlies at least a portion of the aperture in the guide plate, to reduce the tendency for the hooks of the knitting needles to enter the aperture. The guard plate is desirably made from a polymeric material such as polyurethane, and preferably has a Shore A hardness of about 50–70. The guard plate is desirably deformable so that an operator can readily bend it outwardly from the yarn guide while threading a yarn through the yarn guide aperture, yet when the bending force is released, the guard plate readily resumes its initial undeformed configuration.

20 Claims, 1 Drawing Sheet

LOW ABRASION YARN CARRIER FOR KNITTING MACHINES

BACKGROUND OF THE INVENTION

1. Field of the Invention

The invention generally relates to a yarn carrier, and more specifically, to a yarn carrier for feeding a yarn to the needles of a circular knitting machine which minimizes needle wear, and which is easier for an operator to thread.

2. Description of the Prior Art

Circular knitting operations generally utilize one or more circles of needles which knit one or more yarns sequentially to form a continuous tube of fabric. In order to produce a flawless fabric, the manner in which the yarn(s) are fed to the needles must be performed in a precise manner. Present-day circular knitting machines generally utilize a plurality of yarn feeds and operate at high speeds to produce fabrics at high rates of production. However, the speeds at which a machine can be run are generally limited by such factors as the rate at which yarn can be accurately fed to the needles, the rate of needle motion, and the speed with which the needle latches can be accurately opened and closed.

In conventional circular knitting machines, the yarn carrier feeds the yarn to the knitting machine where the cylinder needles intersect with the dial needles or with the sinkers. It is important that the yarn carrier be properly positioned to provide satisfactory yarn feeding to the needles, in order for the knitting operation to proceed smoothly, without interruption, and without the formation of fabric defects. Desirably, the yarn carrier feeds the yarn such that it is readily received by each of the needle hooks, which dictates that the carrier is positioned in extremely close proximity to the circle of needles. However, this close positioning can sometimes result in the needle hooks and/or needle latches having a tendency to enter the opening in the yarn carrier through which the yarn being fed extends. This can cause the needles to become broken or damaged, which can in turn lead to fabric defects and production stoppages. Furthermore, adjustments to the yarn carrier are often required for variations in yarn tension, the tightness of the stitches being knit, tuck stitch formation, and for tuck and welt patterning.

One approach for improving the feeding of yarns to the needles of a knitting machine is described in U.S. Pat. No. 4,441,339 to Yorisue. That patent describes a two piece yarn carrier construction having a yarn guide with a yarn feed aperture and a guard plate overlapping the yarn guide and interposed between the yarn guide and the latch needles. These plates, of which the inventor of the instant invention is a manufacturer and distributor, are customarily made of a thin sheet of metal. These guard plates have been found to perform well in the prevention of premature needle closure and in the prevention of entry of the needle hooks and latches into the yarn feeding aperture of the yarn guide.

One problem which has been encountered with the devices described in the '339 patent, however, is that when an operator attempts to set up the knitting machine by threading each of the yarn guides with their respective yarns, the guard plate tends to interfere with the insertion of the yarn through the yarn guide aperture. Consequently, many operators have a tendency to grab the free end of the guard plate and bend it away from the yarn guide during the threading process. Because the guard plates are made from metal, they often retain a somewhat bent position when the operator releases the free end. This bend can become even more pronounced upon subsequent threading operations. As a result, the guard plate often retains a position in which it extends outwardly from the yarn guide, where it can interfere with the proper motion of the needle latches and yarn feeding. Consequently, fabric defects and even needle smashes can be caused through the improper positioning of the guard plate and its interference with the knitting operation. As should be apparent, interference with proper knitting function can have an extremely negative impact on production efficiency and fabric quality.

Another problem encountered with these prior art yarn carriers is that the guard plate tends to undesirably wear the needle latches and hooks as a result of frictional contact between the needle latches and the guard plate. This can result in a reduction in the life span of the needles, as well as needle damage, which can in turn lead to fabric defects. Similarly, the friction between the needles and the guard plate can have an adverse effect on the guard plate.

SUMMARY OF THE INVENTION

With the foregoing in mind, it is therefore an object of the present invention to provide a yarn carrier which can be easily threaded by an operator, and which reduces the amount of carrier-caused fabric defects.

It is also an object of the instant invention to provide a yarn carrier which reduces the amount of yarn carrier-induced needle wear, and which is sufficiently durable to withstand the rigors of the knitting cycle.

These and other objects are achieved through the provision of a unique multi-part yarn carrier construction. Specifically, the yarn carrier includes a yarn guide having an aperture for receiving a yarn and feeding it to the needles of a knitting machine. The yarn carrier further includes a guard plate having a first portion secured to the yarn guide, and a second portion extending substantially freely from the first portion.

The guard plate is desirably positioned so that it overlies at least a portion of the aperture in the yarn guide, and in particular, so that it overlies a portion of the exit opening of the aperture, where the yarn exits the yarn guide and extends towards the needles of the knitting machine. In this way, the guide plate is interposed between the yarn guide and the needles, where it can function to prevent undesirable contact between the two elements. For example, where the guard plate overlies a portion of the exit opening of the yarn guide aperture, the guard plate serves to substantially prevent the needles of the knitting machine (and in particular, the hooks and latches thereof), from entering the aperture, where they can become damaged or undesirably interfere with the knitting operation. In this way, the amount of carrier-caused needle damage can be minimized, as will be discussed further herein.

The guard plate can include an indentation in its peripheral dimension such that when the guard plate is secured to the yarn guide so that it overlies a portion of the aperture, a portion of the aperture opening adjacent the indentation in the guard plate is left uncovered, due to the indented shape of that portion of the guide plate periphery. The indentation is desirably rounded, so that a smooth edge is provided adjacent the location where the yarn exits the yarn guide aperture. In this way, the yarn does not encounter any sharp edges as it exits the yarn carrier.

The guard plate is desirably made from a flexible, non-metallic material, which is capable of being bent while readily recovering its initial configuration upon release of the bending force. In a preferred form of the invention, the guard plate is made from a polymeric material, and in a particularly preferred form, from a polyurethane material. The guard plate material, in addition to being selected to provide the requisite bending and recovery features, is also selected to be durable in a knitting environment, such that it is capable of withstanding extended contact with lubricants, oils, water, and the like, as well as the mechanical rigors of a knitting operation. For example, polymeric materials having a Shore A hardness of about 50–70 and in particular, those having a durometer reading of about 60, have been found to perform well in the instant invention.

The guard plate is secured to the yarn guide in any desired manner, such as through the use of a pair of clamping plates which sandwich one end of the guard plate while leaving an opposite end of the guard plate free. The clamping plate/guard plate combination can then in turn be screwed or otherwise secured to the yarn guide, such that the guard plate is properly positioned relative to the yarn guide aperture.

DETAILED DESCRIPTION OF THE INVENTION

Figure 1:
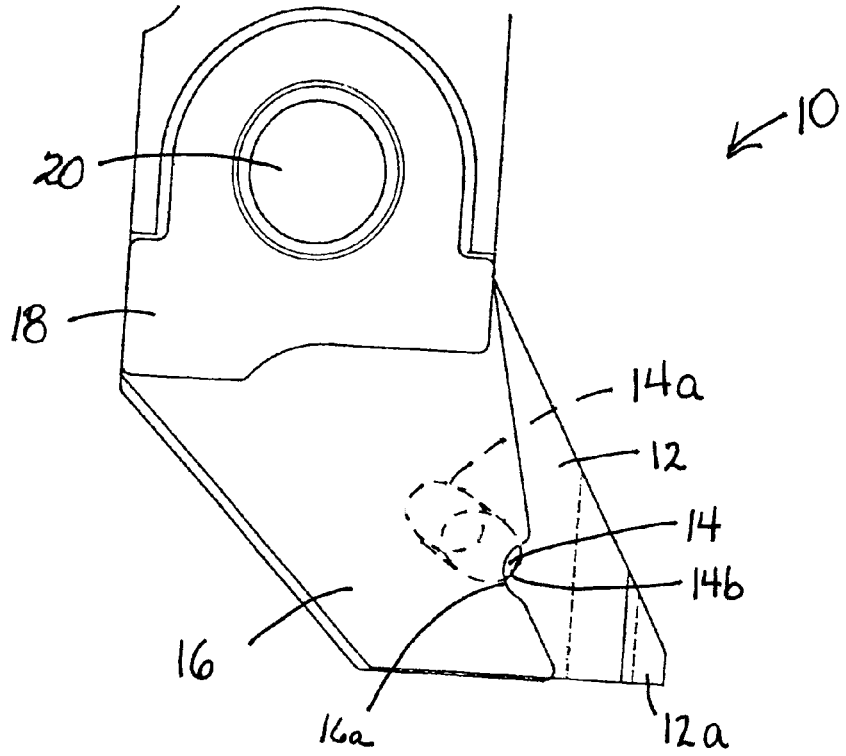
FIG. 1 is a side plan view of a yarn carrier according to the instant invention, illustrating the guard plate as it appears overlying a portion of a yarn guide.
Figure 2:
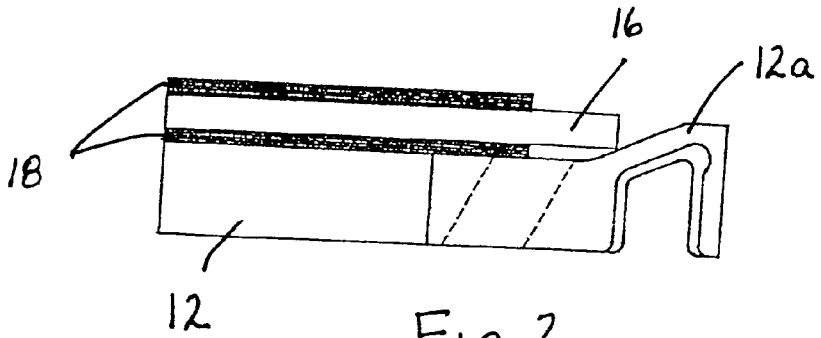
FIG. 2 is a bottom plan view of the yarn carrier illustrated in FIG. 1.

With reference to the drawings, FIG. 1 illustrates a yarn carrier, shown generally at 10, made according to the instant invention. The yarn carrier 10 includes a yarn guide 12 which is formed in the manner of those used in conventional two-part yarn carriers such as that described in U.S. Pat. No. 4,441,339 to Yorisue, which is incorporated herein by reference. As can be seen more clearly in FIG. 2, the yarn guide desirably includes a projection 12*a* which facilitates the proper needle orientation and feeding of the yarn to the open needles. However, other specific shapes and configurations of yarn guide can also be used within the scope of the instant invention, the embodiment illustrated being intended for purposes of explanation of the invention.

The yarn guide 12 also includes a yarn aperture 14 extending through its widthwise dimension, which is adapted to receive a yarn and direct it to the needles of a knitting machine. As illustrated in FIG. 1, the aperture desirably extends downward and forward across the yarn guide so that the yarn enters through an entry opening 14*a* at a rearward portion of the guide, and exits at a point somewhat below and forward of the entry opening, at an exit opening 14*b*. In this way, the yarn is not forced to undergo any 90 degree (or other sharp) turns and no sharp edges are formed proximate the aperture, so that the yarn traveling through the aperture is not scraped along any sharp edges during travel through the yarn guide aperture. The aperture is also desirably substantially cylindrical in shape so as to a provide smooth surface for the yarn(s) passing therethrough.

The yarn carrier 10 further includes a nonmetallic guard plate 16, which is operatively secured to the yarn guide so as to extend substantially coextensively with and substantially parallel to a portion thereof. The guard plate 16 is desirably in the form of a substantially flat sheet of material, though other configurations could be used within the scope of the invention. The non-metallic guard plate 16 is preferably made from a polymeric material which is flexible and is capable of recovering its initial condition after it is subjected to a bending force and the force is released. For example, guard plates formed from polyurethane have been found to provide good flex and recovery properties for use in the invention. However, other non-metallic materials could be used within the scope of the invention, including but not limited to polypropylene, rubber-type materials, polybutadiene, nitrite or other non-metallic materials which may be found to provide the required physical properties as described herein. It is also desirable that the material have sufficient rigidity and durability to withstand the physical rigors of a knitting operation such as contact with the needles and with fast-moving yarns. To this end, non-metallic materials having a Shore A hardness of about 50–70, and in particular, those having a hardness of about 60, have been found to perform well in the invention. In addition, the material is desirably selected to minimize the amount of needle wear which results from the needle latches rubbing against the guard plate.

The guard plate 16 can be made by any method which can be used to produce non-metallic shaped objects; for example, it can be cut or stamped from a flat sheet of polymeric material.

The material preferably has a thickness proportionate to the size of the needles and carriers, in order that it does require that the yarn carrier be spaced too far from the needles to accommodate the thickness of the guard plate. For example, guard plates having a thickness of less than 1 mm, and in particular those having a thickness of about 0.5 mm or less, have been found to perform well in the instant invention.

The material from which the guard plate is produced is also selected to be durable, in order that it can withstand the environment of a knitting operation. For example, the material desirably is capable of withstanding extended contact with oils, lubricants, water, and other materials commonly encountered in a knitting environment, without the material being adversely affected.

As illustrated in the figures, the guard plate 16 is desirably secured to the yarn guide 12 so that a first portion is secured to the yarn guide while a second portion of the guard plate extends substantially freely from the secured portion. The guard plate 16 is also desirably secured such that the plate extends substantially parallel and substantially coextensively with at least a portion of the yarn guide 12. Furthermore, the guard plate 16 is desirably secured such that a portion of it, and preferably the substantially free second portion, overlies at least a portion of the aperture 14 in the yarn guide 12. Preferably, the guard plate 16 overlies a portion of the exit opening 14*b* of the aperture 14, so that the guard plate can cover a portion of that opening to prevent the entry of the needles therein. In this way, the guard plate 16 serves to reduce the tendency for the needles to enter the aperture 14, where they can become damaged or broken.

The guard plate 16 also desirably includes an indentation 16*a* in its peripheral dimension so that when the guard plate is properly secured to the yarn guide, it overlies a portion of the aperture exit opening while leaving a portion of it uncovered. In this way, the effective dimension of the aperture exit opening which the needles confront is reduced, thereby reducing the instance when the needles will enter the aperture. The indentation 16*a* is desirably rounded, so as to provide a smooth edge against which the yarn being fed travels. In this way, the yarn is unlikely to encounter any sharp edges which may serve to snag or damage the yarn as it is fed to the needles at high rates of speed.

The guard plate 16 can be secured to the yarn guide 12 in any desired manner. For example, in the illustrated embodiment of the invention, the guard plate 16 is secured to the yarn guide 12 by way of first and second clamping plates 18, which sandwich the guard plate to provide additional support to it; the clamping plate/guard plate combination is then secured to the yarn guide in a conventional manner, such as by way of a rivet of screw 20. However, other forms of securement could be used within the scope of the instant invention; for example, the clamping plates 18 could be formed as a single folded-over piece of metal which grasps the guard plate along either face, or a single plate could be used to provide support to the guard plate. Alternatively, the guard plate could be secured directly to the yarn guide, without the use of clamping plates.

Many modifications and other embodiments of the invention will come to mind to one skilled in the art to which this invention pertains having the benefit of the teachings presented in the foregoing descriptions and associated drawings. Therefore, it is to be understood that the invention is not to be limited to the specific embodiments disclosed and that the modifications and other embodiments are intended to be included within the scope of the appended claims. Although specific terms are employed herein, they are used in a generic and descriptive sense only and not for purposes of limitation.

That which is claimed:

1. A yarn carrier for feeding yarns to needles of a knitting machine comprising:

a yarn guide having an aperture for receiving a yarn and directing it to the needles of the knitting machine, and a flexible, non-metallic guard plate secured to said yarn guide such that at least a portion of said guard plate overlies at least a portion of said aperture in said yarn guide, to thereby reduce the tendency for the needles of the knitting machine to enter the aperture of the yarn guide during operation of the knitting machine.

2. The yarn carrier according to claim 1, wherein said guard plate is formed from a polymeric material.

3. The yarn carrier according to claim 2, wherein said guard plate is formed from polyurethane.

4. The yarn carrier according to claim 1, wherein said guard plate has a Shore A hardness of about 50–70.

5. The yarn carrier according to claim 4, wherein said guard plate has a Shore A hardness of about 60.

6. The yarn carrier according to claim 1, wherein said guard plate is relatively thinner than said yarn guide.

7. The yarn carrier according to claim 1, wherein said aperture in said yarn guide includes a yarn entry opening and a yarn exit opening, and said aperture is angled such that the axis of the entry opening is not coaxial with the axis of the exit opening, and wherein the guard plate overlies a major portion of the exit opening, to thereby reduce the effective dimension thereof.

8. The yarn carrier according to claim 7, wherein said guard plate has an indentation proximate the exit orifice such that a portion of said exit orifice is not covered by said guard plate.

9. The yarn carrier according to claim 8, wherein said indentation is rounded, so as to provide a smooth surface for contacting a yarn fed through the guide.

10. The yarn carrier according to claim 1, wherein said plate is flexible and recoverable so that said plate returns to its initial relaxed state following the release of a force which flexes the plate.

11. The yarn carrier according to claim 1, wherein said guard plate has a thickness of less than about 1 mm.

12. The yarn carrier according to claim 11, wherein said guard plate has a thickness of less than about 0.5 mm.

13. The yarn carrier according to claim 1, wherein said guard plate is secured to the yarn guide by way of at least one clamping plate which provides support for an upper end of the guard plate and secures it to the yarn guide.

14. A yarn carrier for feeding yarn to needles of a knitting machine comprising:

a yarn guide having an aperture for receiving a yarn traveling therethrough and directing it to the needles of the knitting machine, and a substantially planar guard plate secured to the yarn guide so that it overlies at least a portion of said aperture, said guard plate being formed of a polymeric material and having the ability to recover its initial configuration following the release of a force flexing the plate and having a Shore A hardness of about 50 to 70.

15. The yarn carrier according to claim 14, wherein said guard plate has a rounded indentation in its outer periphery proximate the aperture so as to provide a smooth edge proximate the aperture.

16. The yarn carrier according to claim 14, wherein said guard plate comprises a polyurethane plate having a thickness of about 0.5 mm.

17. The yarn carrier according to claim 1, wherein said guard plate is substantially planar.

18. The yarn carrier according to claim 1, wherein said guard plate defines an indentation and said indentation is proximate said aperture of said yarn guide.

19. The yarn carrier according to claim 1, wherein said guard plate comprises opposite first and second portions, said first portion is secured to said yarn guide, and said second portion is substantially free from said yarn guide.

20. The yarn carrier according to claim 19, wherein:

said second portion is substantially planar, and said second portion defines an indentation and said indentation is proximate said aperture of said yarn guide.

* * * * *